US005595531A

United States Patent [19]

Niemela et al.

[11] Patent Number: 5,595,531

[45] Date of Patent: Jan. 21, 1997

[54] RANDOM ORBIT SANDER HAVING SPEED LIMITER

[75] Inventors: Paul W. Niemela, Pickens; David G. Peot, Easley, both of S.C.

[73] Assignee: Ryobi North America, Easley, S.C.

[21] Appl. No.: 507,109

[22] Filed: Jul. 26, 1995

[51] Int. Cl.[6] ..... B24B 23/00

[52] U.S. Cl. ..... 451/357; 451/359

[58] Field of Search ..... 451/351, 353, 451/357, 359, 456

[56] References Cited

U.S. PATENT DOCUMENTS

| | | | |
|---|---|---|---|
| 4,309,633 | 1/1982 | Marandet | 310/105 |
| 4,517,505 | 5/1985 | Cunningham | 318/611 |
| 4,759,152 | 7/1988 | Berger et al. | 51/120 |
| 4,793,309 | 12/1988 | Huffman et al. | 123/376 |
| 4,819,388 | 4/1989 | Kirkland | 51/411 |
| 5,125,190 | 6/1992 | Buser et al. | 451/359 |
| 5,140,529 | 8/1992 | Peifer | 364/508 |
| 5,141,158 | 8/1992 | Allen | 239/252 |
| 5,149,998 | 9/1992 | Wolcott | 310/105 |
| 5,215,169 | 6/1993 | Kuwahara | 188/164 |
| 5,234,083 | 8/1993 | Lee | 188/267 |
| 5,254,061 | 10/1993 | Leask | 482/63 |
| 5,317,838 | 6/1994 | Bourner | 51/170 |
| 5,349,785 | 9/1994 | Nickels, Jr. et al. | 451/357 |
| 5,354,251 | 10/1994 | Sleamaker | 482/96 |
| 5,384,984 | 1/1995 | Smith | 451/357 |
| 5,392,568 | 2/1995 | Howard, Jr. et al. | 451/357 |
| 5,400,876 | 3/1995 | Duncan | 188/158 |
| 5,425,666 | 6/1995 | Frank et al. | 451/357 |
| 5,458,533 | 10/1995 | Balth et al. | 451/357 |

*Primary Examiner*—Bruce M. Kisliuk
*Assistant Examiner*—Andrew Weinberg
*Attorney, Agent, or Firm*—Brooks & Kushman

[57] ABSTRACT

A random orbit sander having a speed limiter includes a bearing upon which a platen is rotatably mounted. The speed limiter includes a braking member formed of a non-magnetic, electrically conductive material fixed relative to the platen of the sander. The spin limiter also includes at least one magnet supported by a housing of the sander and being disposed adjacent the braking member. A magnetic field formed by the at least one magnet intersects the braking member wherein relative movement between the at least one magnet and the braking member results in the generation of an eddy current force which inhibits rotation of the platen.

11 Claims, 2 Drawing Sheets

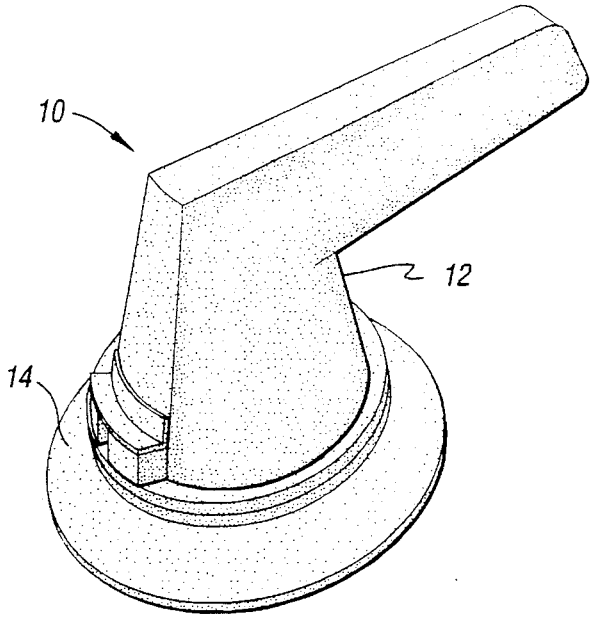
Fig. 1
Fig. 3
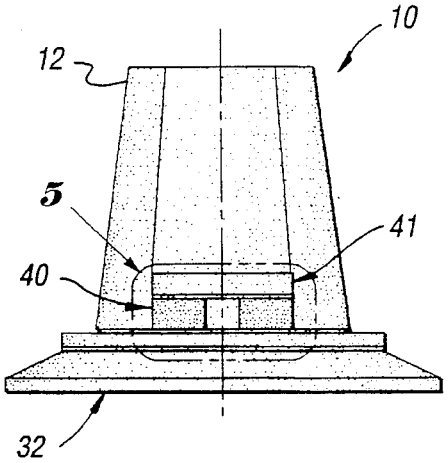
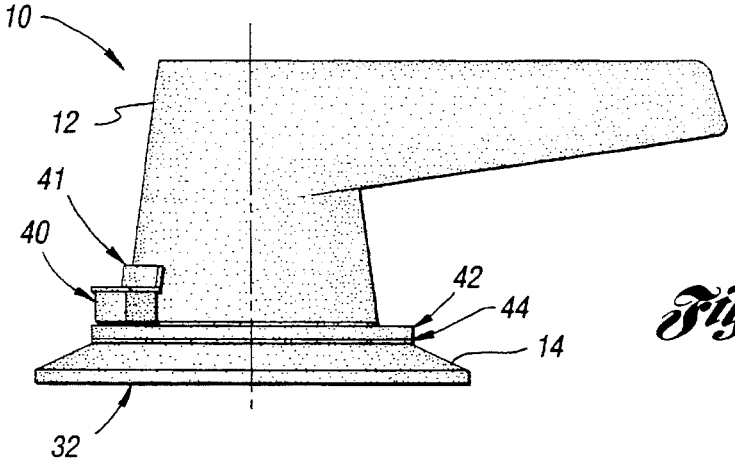
Fig. 4
Fig. 5
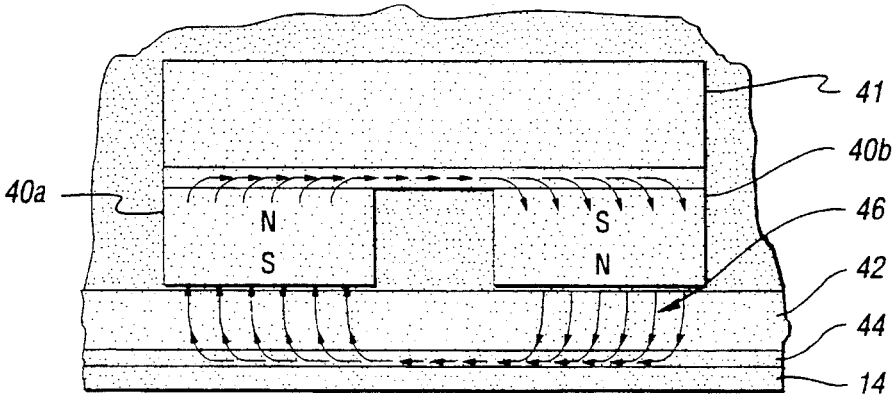

RANDOM ORBIT SANDER HAVING SPEED LIMITER

TECHNICAL FIELD

This invention relates to random orbit sanders having a speed limiter.

BACKGROUND ART

The basic construction of random orbital sanders is well known and typically comprises an essentially circular sanding disc and pad having a central mounting through a freely rotatable bearing eccentrically mounted on the end of a drive spindle. Rotation of the drive spindle causes the sanding disc to orbit about the drive spindle. When no external forces act on the disc, the inherent friction in the bearing results in the disc tending to rotate about the spindle axis at full spindle rotation speed. On the other hand, when light pressure is applied to the sanding disc, rotation of the disc can be prevented and the disc merely orbits as, for example, in a conventional orbit pad sanding machine.

When the sanding pad is engaged with a workpiece surface, the frictional contact between the pad and the workpiece results in a pad rotation at a speed considerably less than the speed of spindle rotation. The pad will rotate in a direction opposite the direction of spindle rotation. This rotation combined with pad orbital movement is very useful in achieving a smooth sanded surface.

However, a problem with prior random orbit sanders is that when the sander is operated with no external forces acting on the sanding pad, it rotates at full spindle speed. Thus, the operator has to be extremely careful when applying the pad to a workpiece, otherwise the inertia of the pad will result in a deep gouge being cut in the workpiece before the pad slows to its far less aggressive random orbit movement.

Various attempts have been made to overcome this problem. For example, U.S. Pat. No. 5,317,838, issued to Bourner, discloses a sanding apparatus having a resiliently biased brake mounted in the housing and is adapted to bear against a low friction annular surface of a platen in a direction substantially parallel to the axis of the drive spindle. The brake is a finger brake and includes a body mounted in the housing, a finger slidable in the body, and a spring disposed between said body and a stem of said finger. This brake, however, adds complexity to the sanding apparatus as well as reliability concerns for the extra components and is subject to wear.

Another known sander having a braking member is disclosed in U.S. Pat. No. 5,392,568, issued to Howard, Jr. et al. The braking member includes a base portion, an outwardly flaring, relatively thin wall portion and an enlarged outermost edge portion adapted to frictionally engage an upper surface of the platen. The braking member is secured to the bottom of the shroud of the housing via a groove formed in its base portion. The braking member exerts a relatively constant spring force against the upper surface of the platen which limits the rotational speed of the platen to approximately 1200 rpm when the platen is lifted off of a work surface without significantly degrading the performance of the sander under load. As described above, this braking member also adds complexity to the sander and is subject to wear.

DISCLOSURE OF THE INVENTION

It is thus a general object of the present invention to provide a braking member for a random orbit sander that creates a braking action proportional to the rotational speed of the platen.

It is another object of the present invention to provide a braking member for a random orbit sander that can be made to be adjustable by either the manufacturer of the sander or by the operator.

It is yet another object of the present invention to provide a braking member for a random orbit sander which does not wear appreciably or require adjustment due to contacting components.

In carrying out the above objects and other objects, features and advantages, of the present invention, a random orbit sander having a free speed limiting mechanism is provided. The random orbit sander includes a housing for supporting a motor and a drive spindle having a longitudinal axis and rotatably mounted to the motor. The sander also includes a freely rotatable bearing disposed eccentrically with respect to the drive spindle. Still further, the sander includes a platen rotatably supported by the bearing and mounted on one end of the drive spindle. The platen includes substantially flat, parallel first and second surfaces lying substantially perpendicular to the spindle axis. The sander is provided with a braking member formed of a non-magnetic, electrically conductive material fixed relative to one of the first surface of the platen or the housing and at least one magnet supported by the other of the platen or the housing adjacent the braking member. A magnetic field formed by the at least one magnet intersects the braking member wherein relative movement between the at least one magnet and the braking member results in the generation of an eddy current force which inhibit rotation of the platen.

The above objects and other objects, features and advantages of the present invention are readily apparent from the following detailed description of the best modes for carrying out the invention when taken in connection with the accompanying drawings.

BRIEF DESCRIPTION OF THE DRAWINGS

FIG. 1 is a perspective view of a random orbit sander in accordance with the preferred embodiment of the present invention;

FIG. 3 is a front view of a preferred embodiment of the random orbit sander of the present invention;

FIG. 4 is a side view of the random orbit sander of FIG. 3; and

FIG. 5 is an enlarged fragmentary view of a portion of the speed limiting mechanism in accordance with circled area 5 in FIG. 3.

BEST MODES FOR CARRYING OUT THE INVENTION

Figure 2:
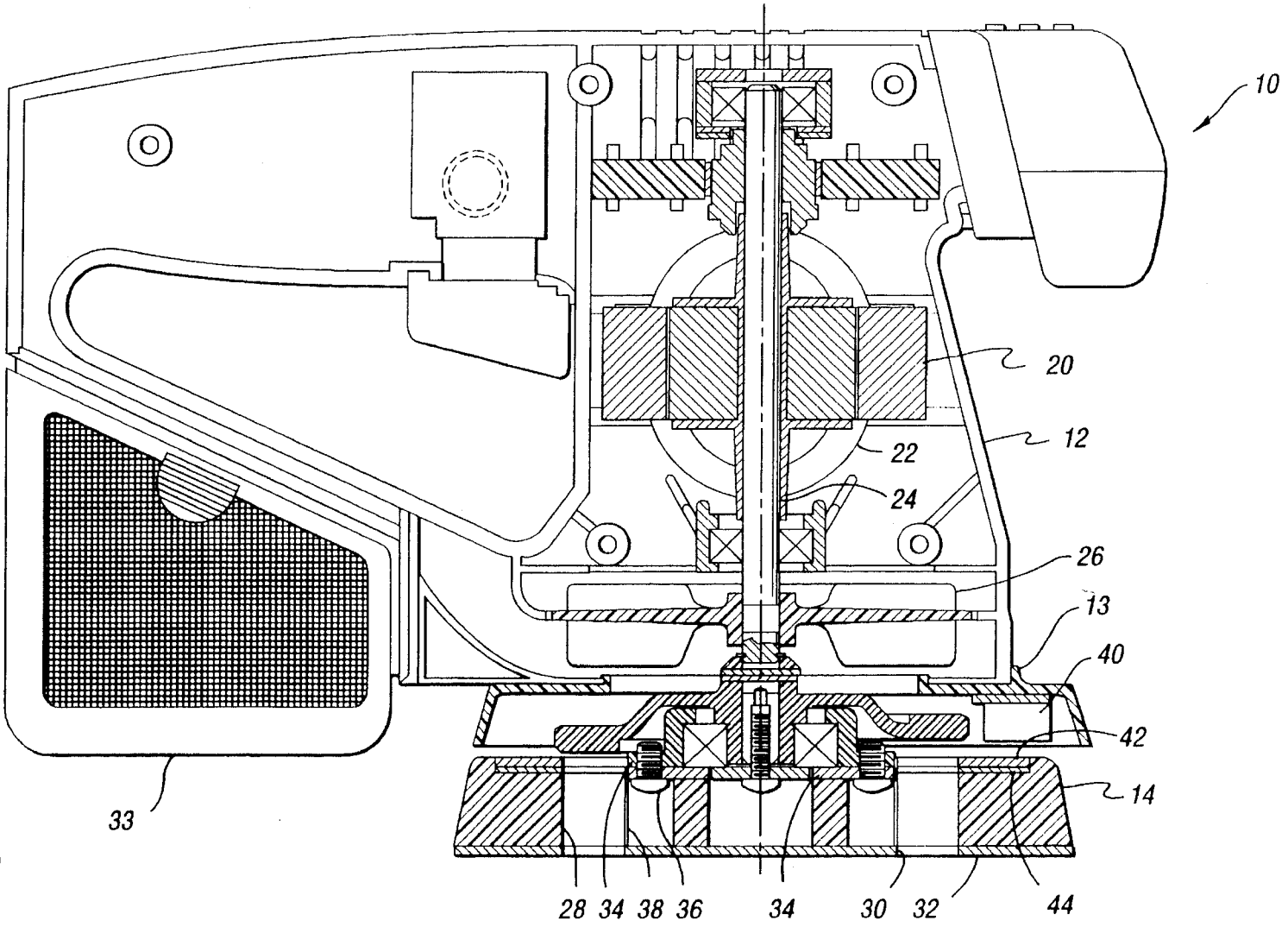
FIG. 2 is a cross-sectional side view of a typical random orbit sander.

Referring now to FIG. 1, there is shown a random orbit sander 10 made in accordance with a preferred embodiment of the present invention. The sander 10 generally includes a housing 12 for supporting a motor (shown in FIG. 2). The sander 10 also includes a platen 14 adapted to be driven rotationally and in a random orbital pattern by the motor disposed in the housing 12.

With reference now to FIG. 2, there is shown a cross-sectional view of a typical random orbit sander. The sander 10 may include a skirt 13 secured to the lower end of the housing 12. The motor can be seen and is designated generally by reference numeral 20. The motor 20 includes an armature 22 having a drive spindle 24 associated therewith. The drive spindle 24 is coupled to a combined motor cooling and dust collection fan 26. Platen openings 28 formed in the platen 14 allow the fan 26 to draw sanding dust up through aligned sandpaper openings 30 in the sandpaper 32 into a dust canister 33 to help keep the work surface clear of sanding dust.

The platen 14 is secured to a bearing 34 via a plurality of threaded screws 36 which extend through openings 38 in the platen 14. The bearing 34 is disposed eccentrically to the drive spindle 24 of the motor 20 which, thus, imparts an orbital motion to the platen 14 as the platen 14 is driven rotationally by the motor 20.

The sander 10 further includes a free speed limiting mechanism for creating electrical eddy currents in the sander 10 in response to rotation of the platen 14 so that a retarding force opposing the drive force is thereby produced. Eddy currents are those currents that exist as a result of voltages induced in the body of a conducting mass by a variation of magnetic flux. In the present invention, the variation in flux is brought about by the relative rotation between the housing 12 and the platen 14 and a magnetic flux fixed with either the housing 12 or the platen 14.

In the preferred embodiment described herein, the magnetic flux is obtained from one or more magnets 40 fixed to the housing 12, as shown in FIGS. 3 and 4. It should be appreciated that if the skirt 13 is provided with the sander 10, the magnet(s) 40 may be secured directly to the skirt 13, as shown in FIG. 2. The magnet(s) 40 may be either permanent magnets or electromagnets. Preferably, the magnet(s) 40 each have a dimension of 0.74×0.5×0.375 inches constructed of ceramic 5 material. The magnet(s) 40 also, preferably, have a residual induction of 3950 Gaus and a coercive force of 2400 Oersteds. The magnet(s) 40 are secured to the housing 12 via a bracket 41, preferably constructed of 0.1 inch thick steel material.

The speed limiting mechanism also includes a braking member 42 formed of a non-magnetic, electrically conductive material fixed relative to the platen 14. The braking member 42 may be constructed of either aluminum or copper or any other suitable non-magnetic, electrically conductive material. Preferably, the braking member 42 is an annular plate identical in size to that of the platen 14. For example, the braking member 42 shown in FIGS. 3 and 4 is constructed of 0.09 inch thick aluminum having a diameter of 5.0 inches. The non-magnetic braking member 42 moving through a magnetic field will generate hysteresis losses within the braking member 42, thus providing a braking force which is proportional to the strength of the magnet(s) 40 passing through the braking member 42, the radial location of the magnetic field and the square of the rotational speed of the platen 14 relative to the magnet(s) 40. For example, a typical sander having a 120 volt, 60 Hz input and a motor speed of 8050 rpm and the speed limiting mechanism described herein would have a pad rotational speed of approximately 1252 rpm.

The strength of the magnetic field is determined by the size and grade of the permanent magnet 40, the proximity of the permanent magnet 40 to the braking member 42, and the shape of the magnetic field. The shape of the magnetic field can be formed by varying the shape and magnetizing direction of the permanent magnet 40.

The shape of the magnetic field can also be formed utilizing a flux member 44 sandwiched between the braking member 42 and the platen 14. The flux member 44 is constructed of material having low permeability to magnetic flux for directing the magnetic field through a directional path between the braking member 42 and the platen 14 to improve the braking action. The flux member 44 is also preferably in the shape of an annular plate to coincide with the shape and size of the platen 14 and the braking member 42. The flux member 44 may be constructed of a steel material or any other suitable magnetic material. For example, the flux member 44 shown in FIGS. 3 and 4 is constructed at 0.05 inch thick steel having a diameter of 5.0 inches.

The magnetic flux is represented in FIG. 5 by the arrows 46. The magnetic flux passes between the housing 12 via the mounting bracket 41 and the platen 14 so that a magnetic torque is produced in response to the relative motion between the housing 12 and the platen 14 and the magnetic flux which is stationary with respect to either the housing 12 or the platen 14. This magnetic torque opposes the mechanical torque produced in response to the circular rotation of the platen 14. The magnetic torque increases with increasing relative speed between the housing 12 and the platen 14, and, more particularly, with increasing speed relative to the flux field.

As shown in FIG. 5, one of the magnets **40*a* has a north pole facing the housing 12 while the second magnet 40*b* has a north pole facing the platen 14. The magnets 40 are preferably spaced 0.03 inches from the braking member 42 and are mounted with their outer edge on a 2.5 inch radius from the center of the motor 20, as shown in FIG. 4. In addition, the magnets 40 are spaced 40° apart, as shown in FIG. 1**.

The design of the sander 10 is not limited to the above-described dimensions. By varying the dimensions of the various components, the retarding of the rotational speed of the platen 14 can be improved. For example, the magnet strength, magnet size, braking member size, flux member size and thickness, magnet mounting thickness, and the radius of the magnet mountings may be increased. Alternatively, the magnets may be positioned closer together and closer to the braking member.

The advantage of the present invention is that it creates a braking action proportion to the rotational speed. The braking member can be adjustable by either the manufacturer of the sander or by the customer. Also, the reliability of the sander is improved since there are no contacting parts requiring adjustment or experiencing degradation.

While the best modes for carrying out the invention have been described in detail, those familiar with the art to which this invention relates will recognize various alternative designs and embodiments for practicing the invention as defined by the following claims.

What is claimed is:

1. A random orbit sander having a free speed limiting mechanism, the sander comprising:

a housing for supporting a motor;

a drive spindle having a longitudinal axis and rotatably mounted to the motor;

a freely rotatable bearing disposed eccentrically with respect to the drive spindle;

a platen rotatably supported by the bearing and mounted on one end of the drive spindle, the platen having substantially flat, parallel first and second surfaces lying substantially perpendicular to the spindle axis;

a braking member formed of a non-magnetic, electrically conductive material fixed relative to one of the first surface of the platen or the housing; and at least one magnet supported by the other of the first surface of the platen or the housing adjacent the braking member so that a magnetic field formed by the at least one magnet intersects the braking member wherein relative movement between the at least one magnet and the braking member results in the generation of an eddy current force which inhibits rotation of the platen.

2. The random orbit sander as recited in claim 1 wherein the braking member is fixed to the first surface of the platen and the at least one magnet is fixed to the housing.

3. The random orbit sander as recited in claim 2 further comprising a flux member of material having low permeability to magnetic flux disposed between the braking member and the platen for directing the magnetic field through a directional path between the braking member and the platen.

4. The random orbit sander as recited in claim 3 wherein the flux member is an annular flat plate.

5. The random orbit sander as recited in claim 1 wherein the braking member is an annular flat plate.

6. The random orbit sander as recited in claim 1 wherein the non-magnetic, electrically conductive material is aluminum.

7. The random orbit sander as recited in claim 1 wherein the non-magnetic, electrically conductive material is copper.

8. The random orbit sander as recited in claim 1 further comprising a sanding disc adapted to be mounted on the second surface of the platen.

9. The random orbit sander as recited in claim 1 further comprising a second magnet oppositely positioned from the at least one magnet.

10. The random orbit sander as recited in claim 1 further comprising a skirt having a first surface and a second surface, the first surface fixed to a lower end of the housing and wherein the braking member is fixed relative to one of the second surface of the skirt or the first surface of the platen and wherein the at least one magnet supported by the other of the second surface of the skirt or the first surface of the platen.

11. A random orbit sander having a free speed limiting mechanism, the sander comprising:

a housing for supporting a motor;

a drive spindle having a longitudinal axis and rotatably mounted to the motor;

a freely rotatable bearing disposed eccentrically with respect to the drive spindle;

a platen rotatably supported by the bearing and mounted on one end of the drive spindle, the platen having substantially flat, parallel first and second surfaces lying substantially perpendicular to the spindle axis;

a braking member formed of a non-magnetic, electrically conductive material fixed relative to the first surface of the platen;

a flux member formed of material having low permeability to the magnetic flux disposed between the braking member and the platen; and at least one magnet supported by the housing adjacent the braking member so that a magnetic field formed by the at least one magnet intersects the braking member wherein relative movement between the at least one magnet and the braking member results in the generation of an eddy current force which inhibits rotation of the platen.

* * * * *